US007877042B2

(12) United States Patent
Fujiwara et al.

(10) Patent No.: US 7,877,042 B2
(45) Date of Patent: Jan. 25, 2011

(54) HEATING ROLLER WITH END COVERS IN AN IMAGE FORMING APPARATUS

(75) Inventors: Yasushi Fujiwara, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 730 days.

(21) Appl. No.: 11/424,796

(22) Filed: Jun. 16, 2006

(65) Prior Publication Data

US 2006/0285889 A1 Dec. 21, 2006

(30) Foreign Application Priority Data

Jun. 17, 2005 (JP) ..... 2005-177993

(51) Int. Cl.
*G03G 15/16* (2006.01)

(52) U.S. Cl. ..... 399/122; 399/328

(58) Field of Classification Search ..... 399/122, 399/328

See application file for complete search history.

(56) References Cited

U.S. PATENT DOCUMENTS 5,835,835 A * 11/1998 Nishikawa et al. ..... 399/328
5,848,331 A * 12/1998 Fromm ..... 399/122

FOREIGN PATENT DOCUMENTS

JP S63-226682 A 9/1988
JP 07049627 A * 2/1995
JP 1996305205 A 11/1996
JP 2005-037442 A 2/2005

OTHER PUBLICATIONS

Machine Translation of Takematsu JP Pub 2005-037442.*
Japanese Patent Office, Notification of Reasons for Refusal for Japanese Patent Application No. 2005-177993 (Counterpart of above-captioned U.S. patent application), dated Aug. 12, 2008 (Partial translation).

* cited by examiner

*Primary Examiner*—David M Gray
*Assistant Examiner*—Laura K Roth
(74) *Attorney, Agent, or Firm*—Baker Botts L.L.P.

(57) ABSTRACT

An image forming apparatus includes a fixing unit for fixing a toner image. The fixing unit includes a heating roller and a pressurizing roller opposed to the heating roller and urged toward the heating roller. A unit case rotatably supports both ends of the heating roller in a longitudinal direction of the heating roller. The unit case is open at one side of the heating roller opposed to the pressurizing roller and covers the other side of the heating roller opposite to the pressurizing roller. A pair of pressurizing roller supporting bodies are respectively provided at both ends in a longitudinal direction of the unit case and rotatably support both ends of the pressurizing roller. A pair of end covers cover both the ends of the heating roller in the longitudinal direction of the heating roller.

18 Claims, 9 Drawing Sheets

HEATING ROLLER WITH END COVERS IN AN IMAGE FORMING APPARATUS

CROSS REFERENCE TO RELATED APPLICATION

This application claims priority from Japanese Patent Application No. 2005-177993, filed on Jun. 17, 2005, the entire subject matter of which is incorporated herein by reference.

TECHNICAL FIELD

Aspects of the present invention relate to a fixing unit for fixing a toner image, which has been transferred onto a recording medium such as recording paper, and an image forming apparatus provided with the fixing unit.

BACKGROUND

In an image forming apparatus of electro-photographic system such as a laser printer, there have been heretofore employed such a process that a surface of a photosensitive member that has been uniformly charged is exposed to light by an optical beam emitted from a light emitting part that includes a laser diode or the like, thereby to form an electrostatic latent image. Then, the electrostatic latent image is formed into a visual image by toner, and thereafter, the visual image is transferred onto a recording medium such as recording paper, whereby the visual image is formed on the recording medium.

However, the image that has been simply transferred will just adheres to the recording medium by electrostatic power and dispersing power, and in that state, the image will be easily removed from the recording medium. Therefore, it is necessary to perform a fixing process for fixing the visual image on the recording medium by heating or so.

Generally, a fixing device for performing the thermal fixing process includes a heating roller and a pressurizing roller. While the recording medium such as recording paper passes between the heating roller and the pressurizing roller, developer such as toner that has been partly melted and admixed by heating will penetrate into the recording medium, and will be fixed. The heating roller contains therein a heat source such as a halogen lamp. The fixing device must have an easily exchangeable structure, because a trouble of the halogen lamp would be such a serious matter that a function as the image forming apparatus may be lost. Under the circumstances, the fixing device has been designed, as a fixing unit that integrally includes the heating roller and the pressurizing roller, and it can be easily exchanged in the event of a trouble (Refer to JP-A-8-305205, for example).

SUMMARY

Because it would be convenient, for a user who uses a printer at home, to install the printer in a narrow space on a bookshelf, for example, there has been a keen request for downsizing the image forming apparatus such as the laser printer. In order to obtain a compact image forming apparatus, it has been requested to downsize the fixing unit too. However, there has been such a problem that it has been difficult to downsize the fixing unit, in the case where the heating roller and the pressurizing roller are totally covered with a case, as in the conventional fixing unit.

Aspects of the invention provide a fixing unit that can be made more compact, and an image forming apparatus.

According to an aspect of the invention, there is provided a fixing unit including: a heating roller; a pressurizing roller opposed to the heating roller and urged toward the heating roller; a unit case that rotatably supports both ends in a longitudinal direction of the heating roller, the unit case being open at one side of the heating roller opposed to the pressurizing roller and covering the other side of the heating roller opposite to the pressurizing roller; a pair of pressurizing roller supporting bodies that are respectively provided at both ends in a longitudinal direction of the unit case and rotatably support both ends of the pressurizing roller; and a pair of end covers that cover both the ends in the longitudinal direction of the heating roller.

The fixing unit according to the aspect of the invention can be made compact, because the unit case is open at the side opposed to the pressurizing roller. At the same time, in spite of being made compact, the pressurizing roller can be reliably pressure contacted with the heating roller, because the pressurizing roller is supported by the pressurizing roller supporting bodies which are held by the unit case. Moreover, because the fixing unit is provided with the end covers for covering the ends in the longitudinal direction of the heating roller, the fixing unit attains such advantage that the heating roller can be thermally insulated with enhanced heat insulation performance, whereby proper fixing process can be achieved.

DETAILED DESCRIPTION

Figure 1:
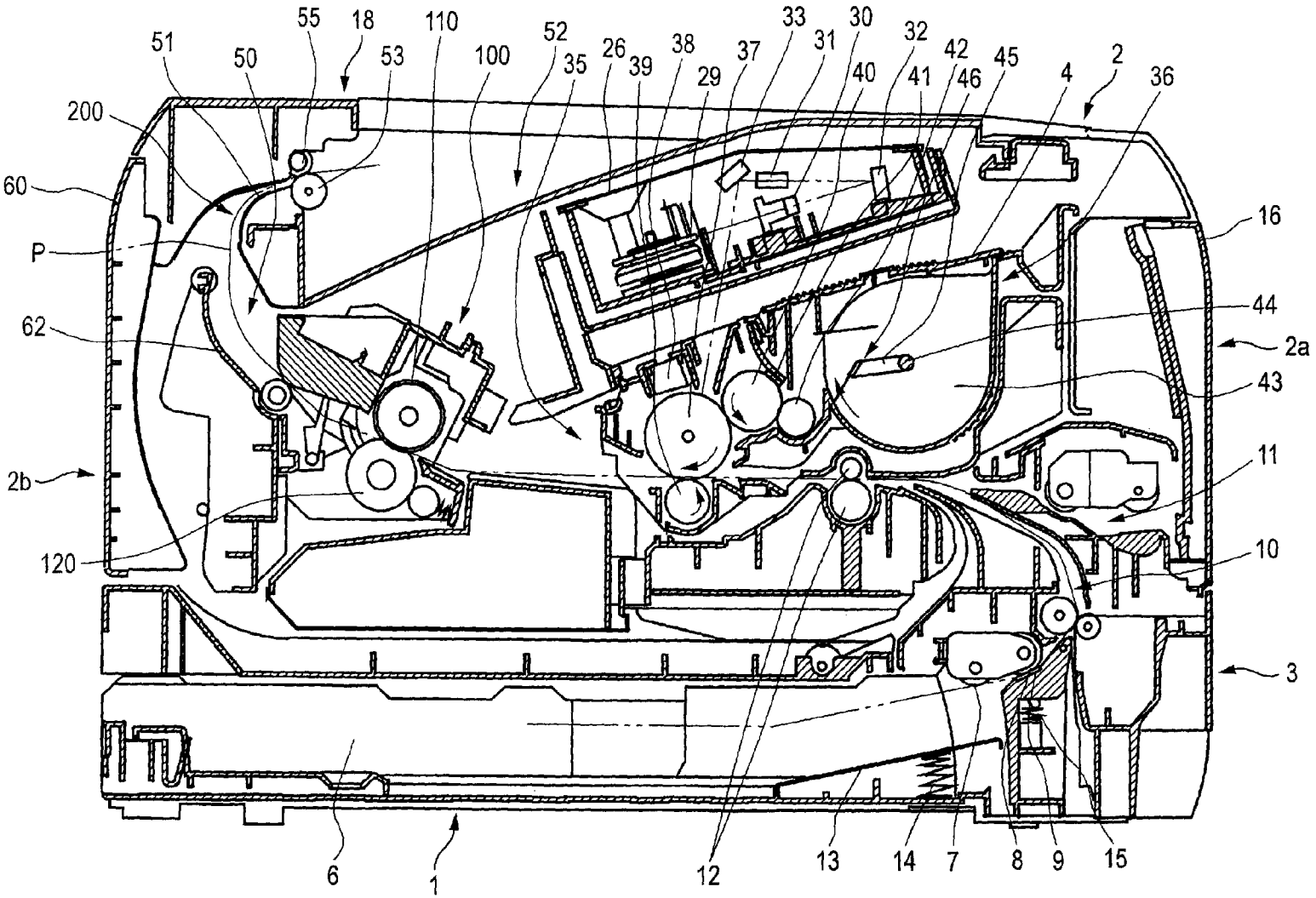
FIG. 1 is a sectional side view schematically showing a laser printer as an aspect of the invention.

Now, referring to the drawings, aspects of the invention will be described in detail.

FIG. 1 is a sectional side view schematically showing a laser printer 1, as an example of the image forming apparatus. The laser printer 1 in the drawing is provided with a casing 2 having a top cover 18 that forms an upper face, and four side faces (only a part thereof is shown) including a front side face 2*a* and a rear side face 2*b*. The top cover 18 is dented into the casing 2 to form a sheet discharging tray 52. A paper feeding cassette 6 capable of containing a plurality of sheets of recording medium such as recording paper is provided below the casing 2, so as to be inserted and extracted from the front side face 2*a* of the casing 2. Moreover, the front side face 2*a* is provided with a manual insertion tray 11, on which the recording medium is separately set, and a front cover 16 that can be opened and closed.

The laser printer 1 includes, inside the casing 2 that is provided with the top cover 18, the front cover 16, and a rear cover 60 provided on the rear side face 2*b*, a paper feeding section 3 for feeding the recording paper or the like as the recording medium (a recording medium conveying path is shown by a phantom line P, in the drawing). Further provided are: a process cartridge 4 as an image forming section for forming a toner image, which is a visual image, on the recording medium that has been fed; a fixing unit 100 for fixing, on the recording medium, the toner image that has been formed thereon; and a paper discharging section 200 for discharging the recording medium that has passed through the fixing unit 100. It is to be noted that in this aspect, the side face close to the fixing unit 100 (the left side face in FIG. 1) is called as the rear side face 2*b*, and the side face at the opposite side is called as the front side face 2*a*, as seen in a direction perpendicular to a rotation axis of a fixing roller (which will be described below) which is provided in the fixing unit 100.

The paper feeding section 3 includes the paper feeding cassette 6, paper feeding rollers 7, 8 and a paper feeding pad 9. The paper feeding cassette 6, paper feeding rollers 7, 8 and paper feeding pad 9 are provided above a forward end (front side) part in a direction of conveying the sheets of the recording medium which are stacked in the paper feeding cassette 6. The paper feeding section 3 is formed with a paper feeding path 10, which is a recording medium conveying path for reversing the recording medium fed from the paper feeding cassette 6 and conveying it to a lower part of the process cartridge 4. The paper feeding section 3 is provided with a pair of registration rollers 12 confronting the paper feeding path 10. It is to be noted that in addition to the recording medium in the paper feeding cassette 6, the recording medium that has been manually set on the manual insertion tray 11 is also fed to the paper feeding path 10. In either case, the recording medium will be temporarily stopped by the pair of the registration rollers 12, and then, will be supplied to the process cartridge 4 according to image forming timing in the process cartridge 4.

The paper feeding cassette 6 is arranged below the process cartridge 4 and the fixing unit 100, and mounted so as to be inserted and extracted from the front side face 2*a* of the casing 2. A paper pressing plate 13 and a spring 14 are provided in the paper feeding cassette 6. The paper pressing plate 13 capable of stacking the sheets of the recording medium in stacked layers is tiltably supported at its one end remote from the paper feeding roller 7, whereby the other end close to the paper feeding roller 7 and so on can move in a vertical direction. The spring 14 is provided so as to upwardly urge a back face of the other end of the paper pressing plate 13 that is close to the paper feeding roller 7 and so on. Accordingly, the paper pressing plate 13 will be downwardly tilted against an urging force of the spring 14 around the end that is remote from the paper feeding roller 7, as a fulcrum, as an amount of the stacked sheets of the recording medium increases.

The paper feeding roller 8 and the paper feeding pad 9 are so arranged as to be opposed to each other. The paper feeding pad 9 is urged toward the paper feeding roller 8 by a spring 15 that is provided at a back side of the paper feeding pad 9. The uppermost sheet of the recording medium among those sheets stacked on the paper pressing plate 13 is pressed by the spring 14 from the back side of the paper pressing plate 13 to be brought into contact with the paper feeding roller 7 and will be fed by the paper feeding roller 7. The uppermost sheet will be clamped between the paper feeding roller 8 and the paper feeding pad 9, and thereafter, will be fed to the paper feeding path 10, while the sheets are separated, one by one, by means of the paper feeding roller 8 and the paper feeding pad 9 with rotation of the paper feeding roller 8.

The recording medium that has been fed from the paper feeding cassette 6 or the manual insertion tray 11 will be sent to the pair of the registration rollers 12 that are arranged above the paper feeding roller 7. The pair of the registration rollers 12 will perform registration with respect to the recording medium that has been fed, and thereafter, convey it to an image forming position (a contact position between a photosensitive drum 37 and a transfer roller 39) in the process cartridge 4.

A scanning unit 26 provided above the process cartridge 4 includes a laser light emitting part (not shown), a polygon mirror 29 that is driven to rotate at high speed, a first scanning lens (fθ lens) 30, a second scanning lens (cylindrical lens) 31, reflective mirrors 32, 33, and so on. An optical beam that has been modulated according to image information emitted from the laser light emitting part will be passed through or reflected by the polygon mirror 29, the first scanning lens 30, the reflective mirror 32, the second scanning lens 31, and the reflective mirror 33 in this order, as shown by a two-dot chain line, whereby a surface of the photosensitive drum 37 inside the process cartridge 4 will be exposed to light by scanning.

The process cartridge 4 includes a drum cartridge 35 and a developing cartridge 36. The drum cartridge 35 contains therein the photosensitive drum 37, a charger 38, the transfer roller 39, and so on. The developing cartridge 36 is detachably mounted on the drum cartridge 35, and contains therein a developing roller 40, a layer thickness regulating blade 41, a supply roller 42, a toner hopper 43, and so on.

Toner in the toner hopper 43 will be agitated by rotation of an agitator 45 that is supported by a rotary shaft 44, in a direction of an arrow mark. The toner will be discharged from a toner supply port 46 that is formed in a side area of the toner hopper 43. Moreover, the supply roller 42 is rotatably arranged at a sideward position of the toner supply port 46, and the developing roller 40 is rotatably arranged so as to be opposed to the supply roller 42. The supply roller 42 and the developing roller 40 are in contact with each other in a state where they are respectively compressed to some extent.

The developing roller 40 has a roller shaft made of metal, and a roller formed of electrically conductive rubber material is covered over the roller shaft. The developing roller 40 is driven to rotate in a direction of an arrow mark (in a counterclockwise direction). Moreover, the developing roller 40 is so constructed that a developing bias is applied thereto. The layer thickness regulating blade 41 is arranged in the vicinity of the developing roller 40. The layer thickness regulating blade 41 has a blade body made of metallic leaf spring material, and a pressing part having a semicircular shape in cross section and formed of insulating silicone rubber. The pressing part is provided at a tip end of the blade body. The layer thickness regulating blade 41 is supported by the developing cartridge 36 in the vicinity of the developing roller 40 and so constructed that the pressing part is pressure contacted with the developing roller 40 by a resilient force of the blade body.

The toner discharged from the toner supply port 46 will be supplied to the developing roller 40 with rotation of the supply roller 42. On this occasion, the toner will be positively charged by friction between the supply roller 42 and the developing roller 40. Further, the toner supplied to a surface of the developing roller 40 will intrude between the pressing part of the layer thickness regulating blade 41 and the developing roller 40, with the rotation of the developing roller 40, and will be carried on the developing roller 40, as a thin layer having a certain thickness.

The photosensitive drum 37 is arranged adjacent to the developing roller 40 so as to rotate in a direction of an arrow mark (in a clockwise direction) in a state opposed to the developing roller 40. A drum body of this photosensitive drum 37 is earthed, and its surface is formed of a photosensitive layer composed of polycarbonate or the like to be positively charged.

The charger 38 is arranged above the photosensitive drum 37 in a diagonally leftward direction, keeping a predetermined distance therefrom. This charger 38 is a scorotron type charger for positive charge, which generates corona discharge from an charging wire of tungsten or the like and is so constructed as to positively charge the surface of the photosensitive drum 37 uniformly.

The transfer roller 39 is arranged below the photosensitive drum 37 in a manner opposed to the photosensitive drum 37 and supported by the drum cartridge 35 so as to rotate in a direction of an arrow mark (in a counterclockwise direction). This transfer roller 39 has a roller shaft made of metal and a roller formed of electrically conductive rubber material that is covered over the roller shaft. The transfer roller 39 is so constructed that a transfer bias is applied thereto, when transferring process is conducted.

The surface of the photosensitive drum 37 will be positively charged uniformly by the charger 38 with the rotation of the photosensitive drum 37. Then, the surface of the photosensitive drum 37 will be exposed to light by the laser beam from the scanning unit 26 thereby to form an electrostatic latent image. Thereafter, when the toner carried on the developing roller 40 and positively charged comes into contact with the photosensitive drum 37, the toner will be supplied to the electrostatic latent image that has been formed on the surface of the photosensitive drum 37 by the developing bias applied to the developing roller 40, that is, to the area exposed to light by the laser beam and having a lowered electric potential, out of the surface of the photosensitive drum 37 that has been positively charged uniformly. Then, the toner will be selectively carried on the area, whereby a toner image will be formed (reverse development).

Thereafter, the toner image carried on the surface of the photosensitive drum 37 will be transferred onto the recording medium by the transfer bias applied to the transfer roller 39, while the recording medium passes between the photosensitive drum 37 and the transfer roller 39. The fixing unit 100 is arranged above the paper feeding cassette 6, adjacent to the process cartridge 4 and at a downstream side from the process cartridge 4 in a direction of conveying the recording medium. The fixing unit 100 includes a heating roller 110 provided with a heater therein, as a fixing roller, and a pressurizing roller 120 that is arranged in a manner opposed to the heating roller 110 and urged so as to pressurize the heating roller 110.

In the fixing unit 100, the toner image, which is a visual image transferred onto the recording medium in the process cartridge 4, will be fixed by heating, while the recording medium passes between the heating roller 110 and the pressurizing roller 120. Thereafter, the recording medium will be conveyed toward a paper discharging path 50 that is a recording medium conveying path formed in the paper discharging section 200.

The paper discharging section 200 includes an inner guide member 51 and an outer guide member 62, which define the paper discharging path 50, and a pair of paper discharging rollers including a lower paper discharging roller 53 and an upper paper discharging roller 55, which are provided at a discharge port for discharging the recording medium onto the sheet discharging tray 52 that is formed on the top cover 18.

The sheet discharging tray 52 is in a shape of a substantially rectangular plate in a plan view and has such a structure that a rearward end part thereof is dented into the casing 2 to form a dented part. The sheet discharging tray 52 is gradually inclined upwardly from the rearward end to a front side.

The recording medium that has passed through the fixing unit 100 and sent to the paper discharging path 50 will be conveyed to the pair of the paper discharging rollers 53, 55, after the recording medium has been turned upside down in a sheet forwarding direction by means of the inner guide member 51 and the outer guide member 62, and then, will be discharged onto the sheet discharging tray 52 through the paper discharging rollers 53, 55, toward the front side.

Figure 2:
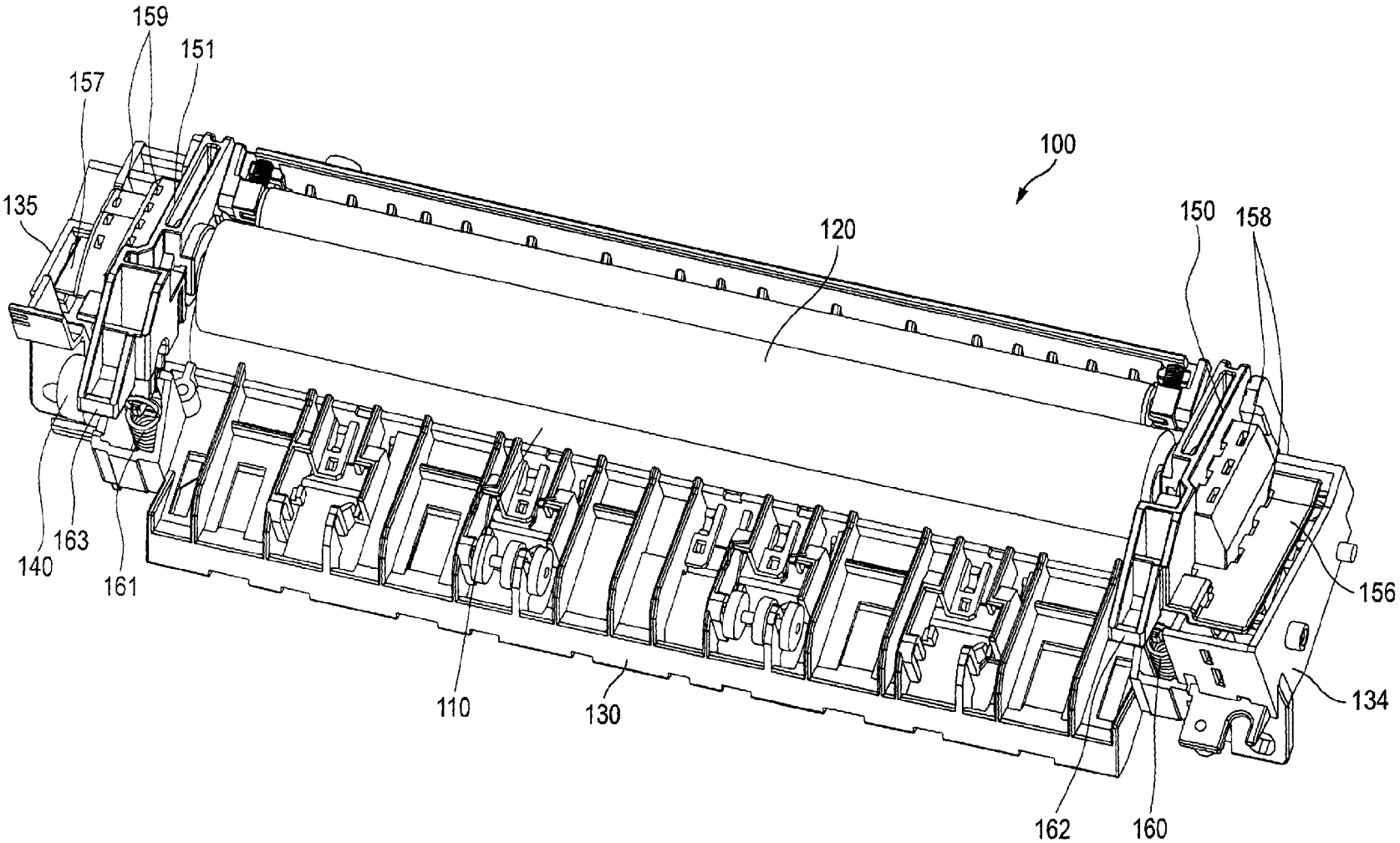
FIG. 2 is an enlarged perspective view showing a fixing unit in the aspect, in a state where the fixing unit has been turned upside down.
Figure 3:
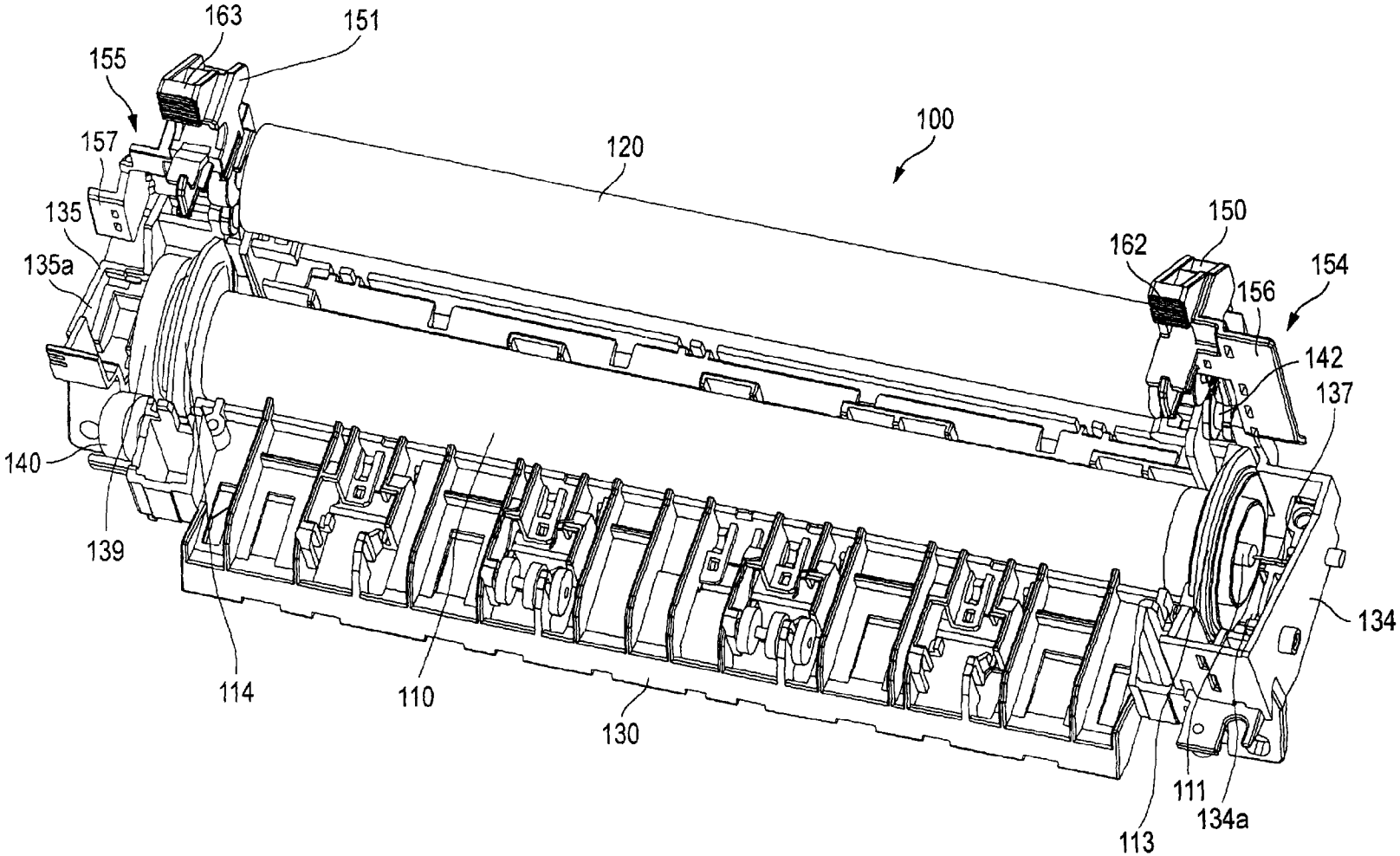
FIG. 3 is an enlarged perspective view showing the fixing unit in the aspect, in a state where the fixing unit has been turned upside down, and pressurizing roller supporting bodies have been rotated.
Figure 4:
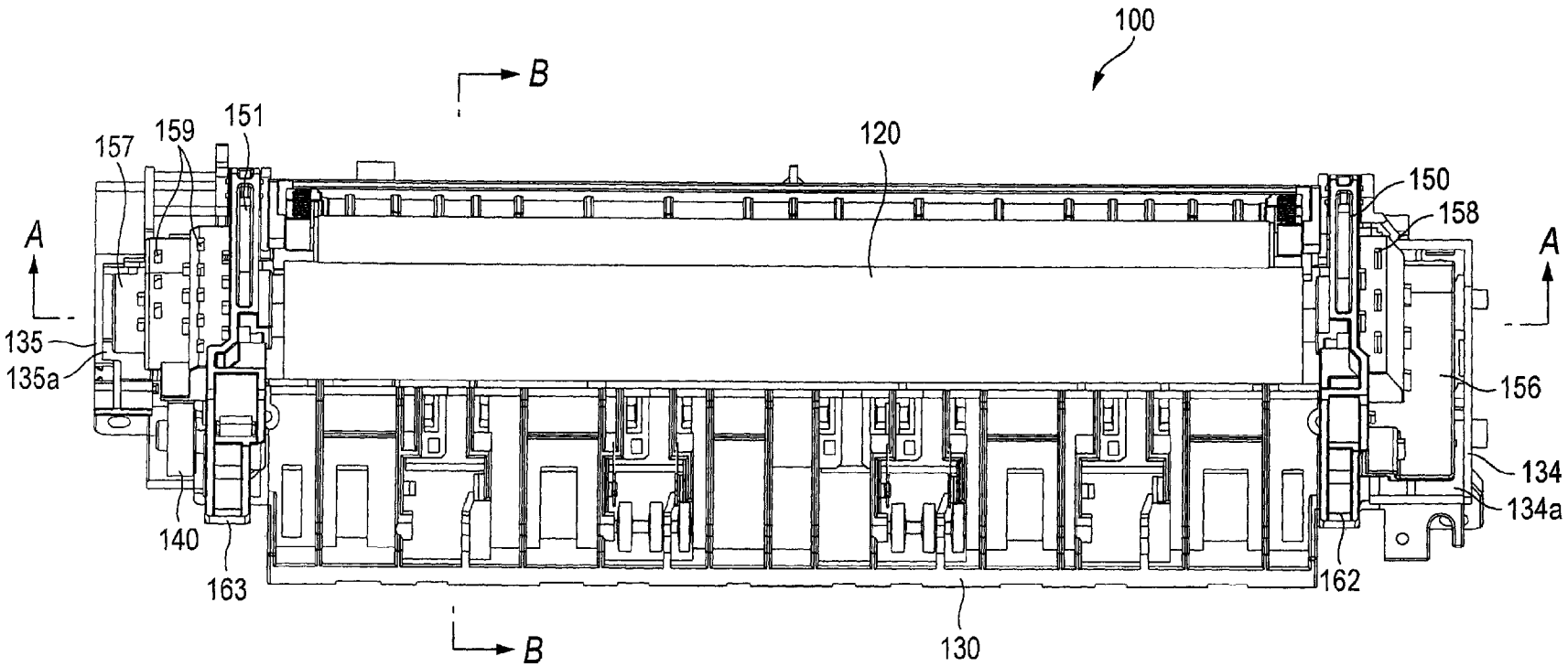
FIG. 4 is a bottom view of the fixing unit in the aspect.
Figure 5:
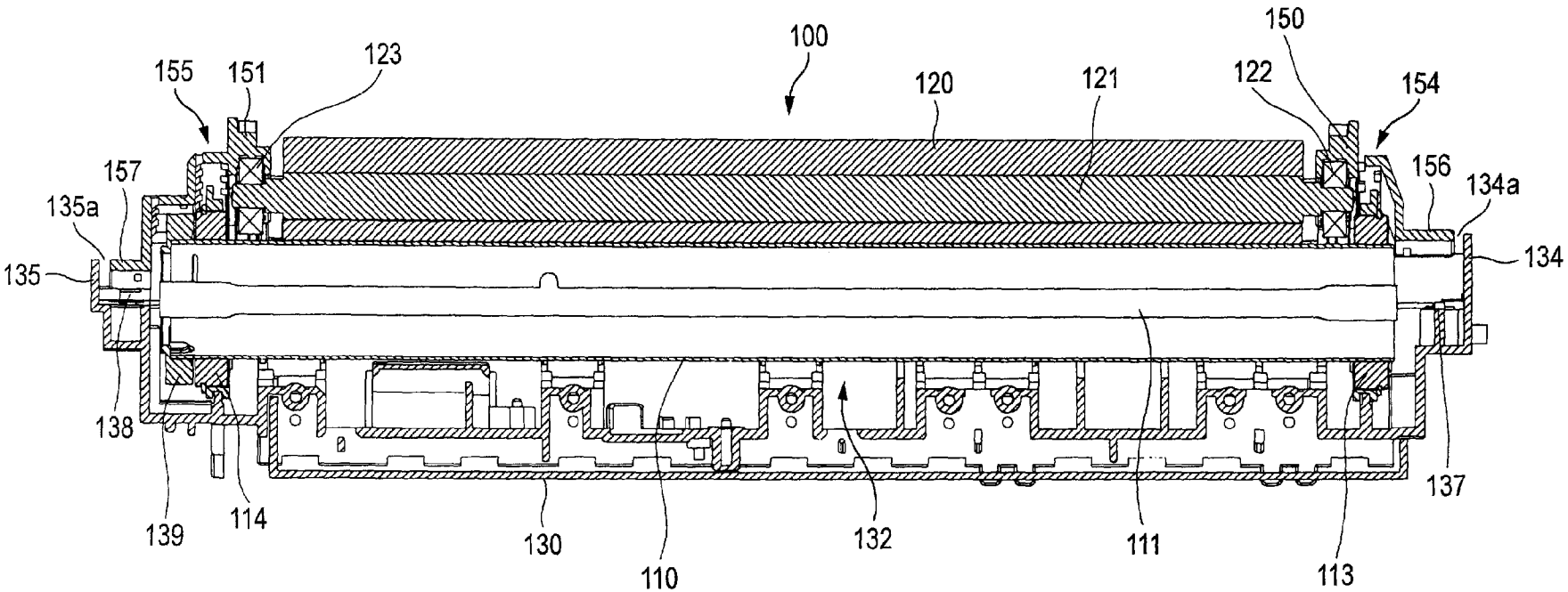
FIG. 5 is a sectional view taken along a line A-A in FIG. 4.
Figure 6:
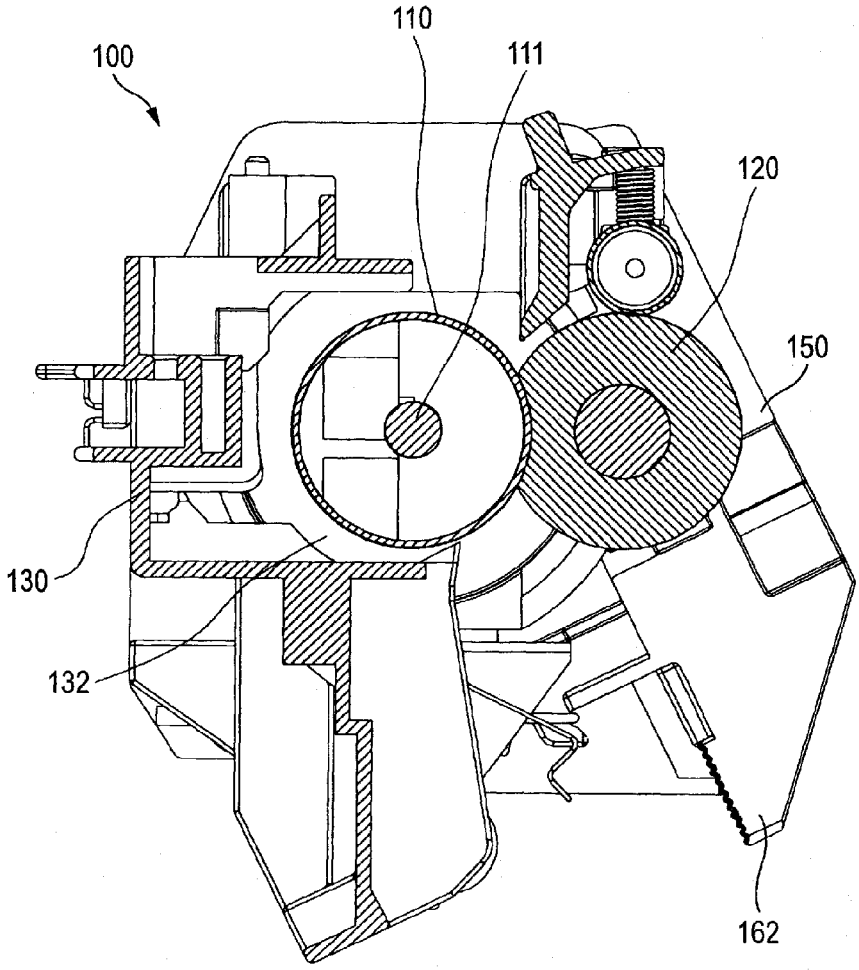
FIG. 6 is an enlarged sectional view taken along a line B-B in FIG. 4.

Now, a structure of the fixing unit 100 in this aspect will be described in detail. FIG. 2 is an enlarged perspective view showing the fixing unit 100 in a state turned upside down. FIG. 3 is also an enlarged perspective view of the fixing unit 100 in a state where the fixing unit 100 has been turned upside down, and pressurizing roller supporting bodies 150, 151, which will be described below, have been rotated to separate the pressurizing roller 120 from the heating roller 110. FIG. 4 is a bottom view of the fixing unit 100, FIG. 5 is a sectional view taken along a line A-A in FIG. 4, and FIG. 6 is an enlarged sectional view taken along a line B-B in FIG. 4.

The fixing unit 100 in this aspect includes the heating roller 110 provided with a heater 111, and the pressurizing roller 120 that is so arranged as to be opposed to the heating roller 110 for pressurizing a surface of the heating roller 110. The heating roller 110 is formed of metal into a cylindrical shape with its both ends open, and incorporates therein the heater 111 including a halogen lamp, for example. The heating roller 110 is so constructed as to be heated by the heater 111.

Bearing members 113, 114 are fitted to outer peripheral faces of both the ends in a longitudinal direction of the heating roller 110. The bearing members 113, 114 are attached to both ends in the longitudinal direction of a unit case 130, whereby the heating roller 110 is rotatably supported by the unit case 130. The bearing members 113, 114 formed of synthetic resin, or ball bearing or the like may be employed.

The pressurizing roller 120 is rotated, following the rotation of the heating roller 110, in a state where it pressurizes the heating roller 110. The heating roller 110 has such a structure that its upper part is covered with the unit case 130 molded of resin such as polyethylene terephthalate (PET), while its lower side opposed to the pressurizing roller 120 is not covered with the unit case 130, but open. According to this structure, the fixing unit 100 will be downsized, whereby the image forming apparatus can be made compact in its entirety.

Specifically, as shown in FIG. 5, the unit case 130 has a containing room 132 that contains the heating roller 110, while the containing room 132 is open at a side opposed to the pressurizing roller 120. The heating roller 110 is contained in this containing room 132 in a state where its one side opposed to the pressurizing roller 120 is exposed. According to this structure, the heating roller 110 is covered with the unit case 130 except the side opposed to the pressurizing roller 120, for heat insulation, so that the heating roller 110 can be thermally insulated.

Moreover, at both ends in the longitudinal direction of the heating roller 110, first end covers 134, 135 for covering both ends of the heating roller 110 are formed of resin, integrally with the unit case 130. The first end covers 134, 135 are so formed as to cover the heating roller 110, which are projected outwardly from the bearing members 113, 114. The first end covers 134, 135 are provided with openings 134*a*, 135*a* at the side opposed to the pressurizing roller 120.

Terminal boards 137, 138 are arranged inside the first end covers 134, 135. Electrode wires from the heater 111, which is incorporated in the heating roller 110, are extended to the exterior from openings at both the ends of the heating roller 110, and connected to the terminal boards 137, 138. The heating roller 110 is further provided with a gear 139 on a peripheral face of its one end. The gear 139 is also contained in one of the first end covers 135.

A small gear 140 that is meshed with the gear 139 is rotatably supported by the unit case 130. One of the first end cover 135 is cut away so that the small gear 140 may be exposed to the exterior. Driving force will be transmitted to the small gear 140 from a driving motor or the like, which is not shown.

The pressurizing roller 120 includes an elastic body formed of silicone rubber or the like and a film of PTFE (polytetrafluoroethylene) wrapped on the elastic body. Both ends in the longitudinal direction of a rotation shaft 121 of the pressurizing roller 120 are rotatably supported by a pair of pressurizing roller supporting bodies 150, 151 via bearings 122, 123.

The pair of the pressurizing roller supporting bodies 150, 151 are rotatably supported at their respective one ends by support shafts 142 (only one is shown in FIG. 3), which are provided at both the ends in the longitudinal direction of the unit case 130. The support shafts 142 are provided in parallel with the heating roller 110 and the pressurizing roller 120, at a position apart from the heating roller 110 by a predetermined distance. The support shafts 142 are so constructed that the pressurizing roller 120 can be brought into contact with or separated from the heating roller 110, when the pressurizing roller supporting bodies 150, 151 have been rotated around the support shafts 142.

Springs 160, 161 as resilient bodies, which are engaged with the unit case 130 at their respective one ends, are locked to the pressurizing roller supporting bodies 150, 151 at opposite sides to the support shafts 142, interposing the pressurizing roller 120. The pressurizing roller 120 is urged toward the heating roller 110 by restoring forces of the springs 160, 161. For this reason, it is unnecessary to provide urging means in a lower part of the pressurizing roller 120 and to cover the pressurizing roller 120 with the unit case 130. The pressurizing roller supporting bodies 150, 151 are further provided with handles 162, 163 at a downstream side in a direction of conveying the recording medium. In case of conducting maintenance or so for the fixing unit 100, a user can easily perform the maintenance by operating the handles 162, 163, in an open state of the rear cover 60.

The pressurizing roller supporting bodies 150, 151 in this aspect are projected outwardly from the outer periphery of the pressurizing roller 120 at an opposite side to the heating roller 110. According to this structure, when the fixing unit 100 is placed on a flat plane with the pressurizing roller supporting bodies 150, 151 directed downwardly, the surface of the pressurizing roller 120 will not get in touch with the flat plane, because the pair of the pressurizing roller supporting bodies 150, 151 come into contact with the flat plane.

The pressurizing roller 120 includes the elastic body formed of silicone rubber or the like in a rod-like shape, which is inserted into a tube formed of PTFE. When the surface of the pressurizing roller 120 has a scratch, a difference in fixing strength may occur in an area having the scratch, which will cause a fixing blur. As described above, downsizing of the fixing unit 100 is achieved in this aspect, by not covering the lower part of the pressurizing roller 120 with the unit case 130. However, on occasion of performing maintenance or so, it is necessary to detach the fixing unit 100 and place it on a work table or the like. Sometimes, on such occasions, it is not always possible to place the fixing unit 100 with the surface of the pressurizing roller 120 directed upwardly, according to items of the maintenance work. Even in such cases, according to the above-described structure, the surface of the pressurizing roller 120 will be prevented from having a scratch. It is also possible to prevent the surface of the pressurizing roller 120 from getting in touch with the flat plane, by providing support members extended from the unit case 130.

The pressurizing roller supporting bodies 150, 151 are provided with second end covers 154, 155. In this aspect, the pressurizing roller supporting bodies 150, 151 and the second end covers 154, 155 are integrally formed of resin. In this manner, the number of components and the number of assembling steps can be decreased. The second end covers 154, 155 are provided outside in the axial direction of the pressurizing roller 120. The second end covers 154, 155 are so formed as to cover the bearing members 113, 114 of the heating roller 110, in a state where the pressurizing roller 120 is in contact with the heating roller 110, as shown in FIG. 2. The second end covers 154, 155 are further provided with lid portions 156, 157 that close the openings 134*a*, 135*a* in the first end covers 134, 135 of the unit case 130.

When the springs 160, 161 have been released from the locked state thereby to rotate the pressurizing roller supporting bodies 150, 151 around the support shafts 142 in a direction of separating the pressurizing roller 120 from the heating roller 110, as shown in FIG. 3, the lid portions 156, 157 of the second end covers 154, 155 will open the openings 134*a*, 135*a* in the first end covers 134, 135. At the same time, the second end covers 154, 155 will be separated from the bearing members 113, 114. In this aspect, a plurality of small holes 158, 159 are formed in the second end covers 154, 155. The small holes 158, 159 are formed for preventing deformation of the second end covers 154, 155, when they are molded of resin, and may be formed according to necessity.

Now, operation of the fixing unit 100 in this aspect and the laser printer 1 employing the fixing unit 100 will be described.

As a first step, the uppermost recording medium in the paper feeding cassette 6 will be fed by the paper feeding roller 7. The recording medium will be clamped between the paper feeding roller 8 and the paper feeding pad 9, and thereafter, fed toward the paper feeding path 10. The recording medium will pass the paper feeding path 10 and temporarily stop at the pair of the registration rollers 12, and thereafter, supplied to the image forming section in the process cartridge 4 according to the timing of image formation.

The surface of the photosensitive drum 37 will be positively charged uniformly by the charger 38 and exposed to light by a laser beam from the scanning unit 26 thereby to form an electrostatic latent image. Thereafter, the toner will be brought into contact with the surface of the photosensitive drum 37 thereby to form a toner image. When the recording medium passes between the photosensitive drum 37 and the transfer roller 39, the toner image will be transferred onto the recording medium, and fixed by heating, while the recording medium passes between the heating roller 110 and the pressurizing roller 120 in the fixing unit 100. Thereafter, the recording medium will pass through the paper discharging path 50, and will be discharged onto the sheet discharging tray 52.

In the fixing unit 100, the heating roller 110 will be heated by the heater 111, and the pressurizing roller 120 will be pressure contacted with the heating roller 110 by the urging forces of the springs 160, 161 via the pressurizing roller supporting bodies 150, 151. The toner will be fixed by heating while the recording medium passes between the heating roller 110 and the pressurizing roller 120.

Because the heating roller 110 is contained in the containing room 132 of the unit case 130, except the side opposed to the pressurizing roller 120, thermal insulation will be achieved. In this manner, the heating roller 110 will be thermally insulated so that the fixing process by the heating roller 110 and the pressurizing roller 120 can be appropriately performed.

Moreover, because both the open ends of the heating roller 110 are covered with the first end covers 134, 135 and the second covers 154, 155 in directions up and down, right and left, and front and rear for heat insulation, radiation of heat from the ends of the heating roller 110 can be also prevented. Further, because the second end covers 154, 155 are provided on the pressurizing roller supporting bodies 150, 151, when the pressurizing roller supporting bodies 150, 151 are rotated around the support shafts 142 to separate the pressurizing roller 120 from the heating roller 110, the openings 134*a*, 135*a* of the first end covers 134, 135 will be opened to expose the heating roller 110 and the bearing members 113, 114, whereby it is possible to easily conduct maintenance, inspection, and exchange of the heating roller 110 and the heater 111.

Figure 7:
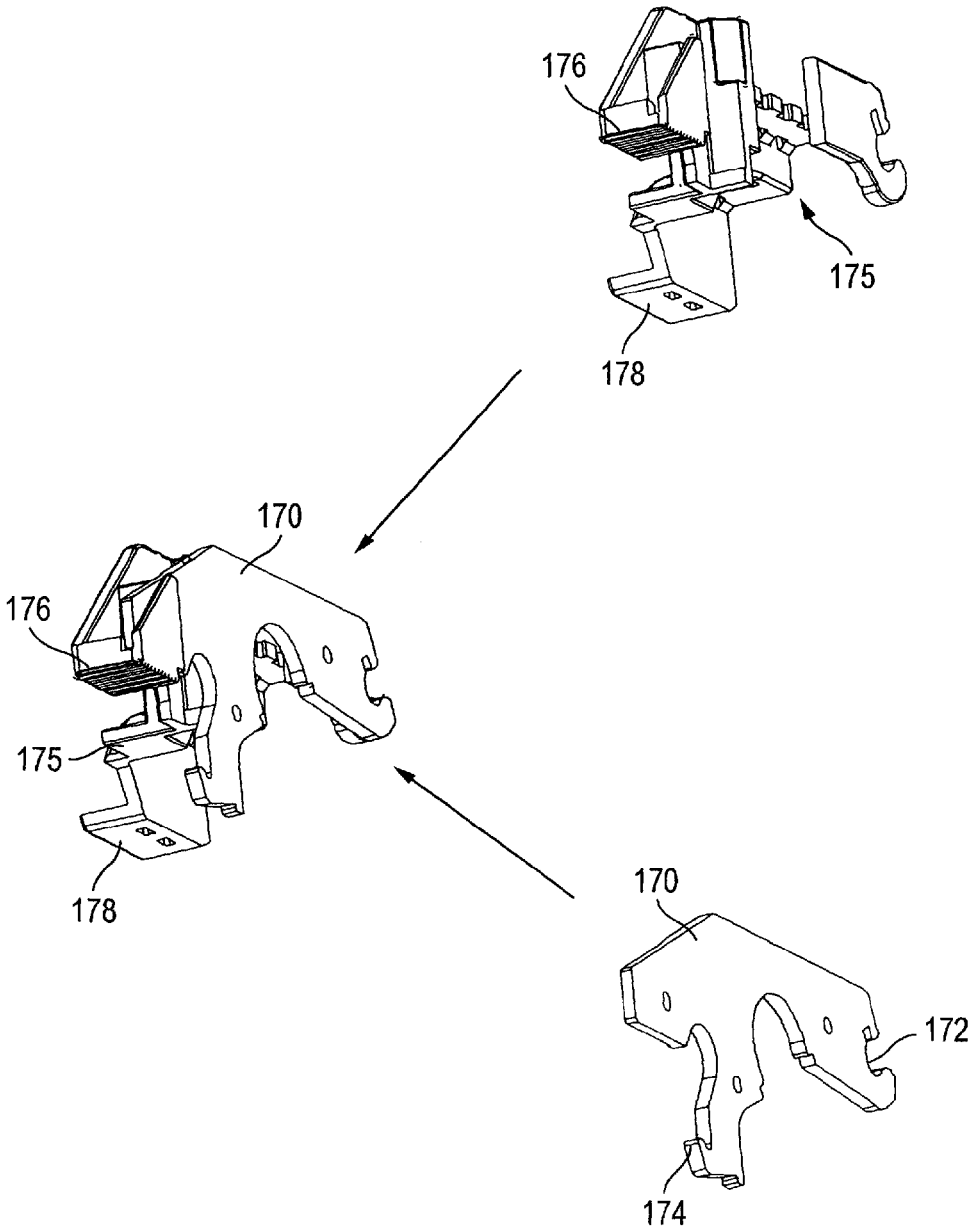
FIG. 7 is an exploded perspective view showing a pressurizing roller supporting body and a second end cover in another aspect.

Although the pressurizing roller supporting bodies 150, 151 and the second end covers 154, 155 are integrally formed of resin in the above described aspect, another aspect in which they are formed of separate materials will be described referring to FIG. 7. FIG. 7 is exploded perspective views of a pressurizing roller supporting body 170 and a second end cover 175 corresponding to the pressurizing roller supporting body 151 and the second end cover 155 in the above described aspect, in a state assembled to the laser printer 1.

The pressurizing roller supporting body 170 is formed of metal in a shape of a substantially flat plate. The pressurizing roller supporting body 170 has a groove 172 to be engaged with the support shaft 142, and a hook portion 174 to which the spring 161 is locked. The second end cover 175 is formed of resin separately from the pressurizing roller supporting body 170. The second end cover 175 is provided with a handle 176 similar to the above described handle 163, and a lid portion 178 similar to the lid portion 157. The case is the same with the pressurizing roller supporting body 150 and the second end cover 154 at the other side, which has been described above. The pressurizing roller supporting body 150 is formed of metal and the second end cover 154 is formed of resin.

In this aspect as well, in the same manner as in the above described aspect, the heating roller 110 can be thermally insulated by the resin having high heat insulation performance. At the same time, the pressurizing roller supporting body 170 made of metal can bear an acting force when the pressurizing roller 120 comes into pressure contact with the heating roller 110, whereby rigidity will be enhanced.

Figure 8:
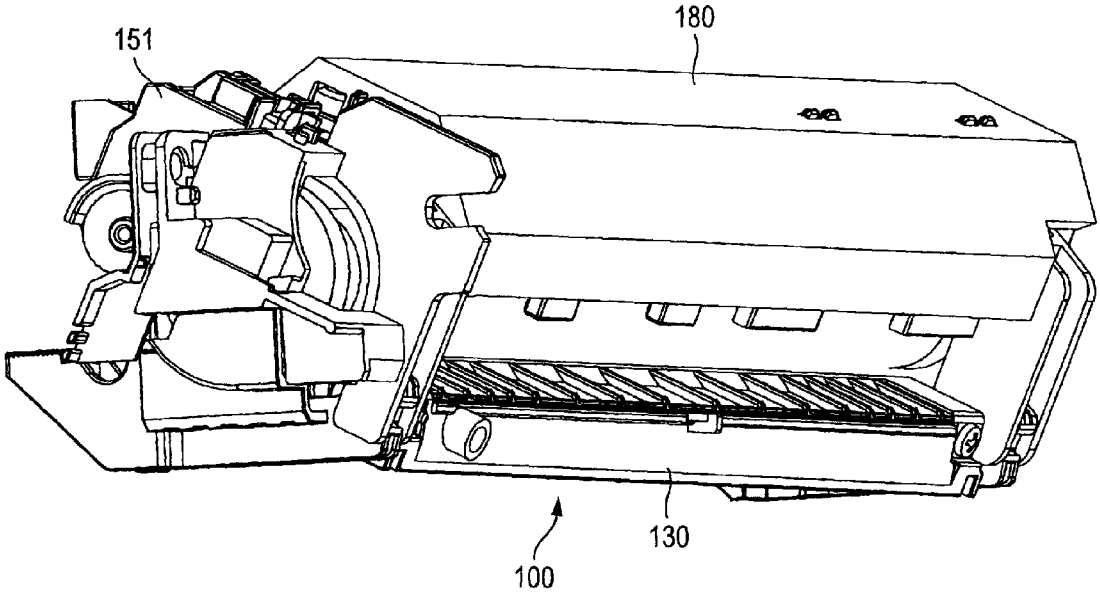
FIG. 8 is an enlarged perspective view showing the fixing unit in the aspect, in a state where a heat insulating cover is fitted to the fixing unit.
Figure 9:
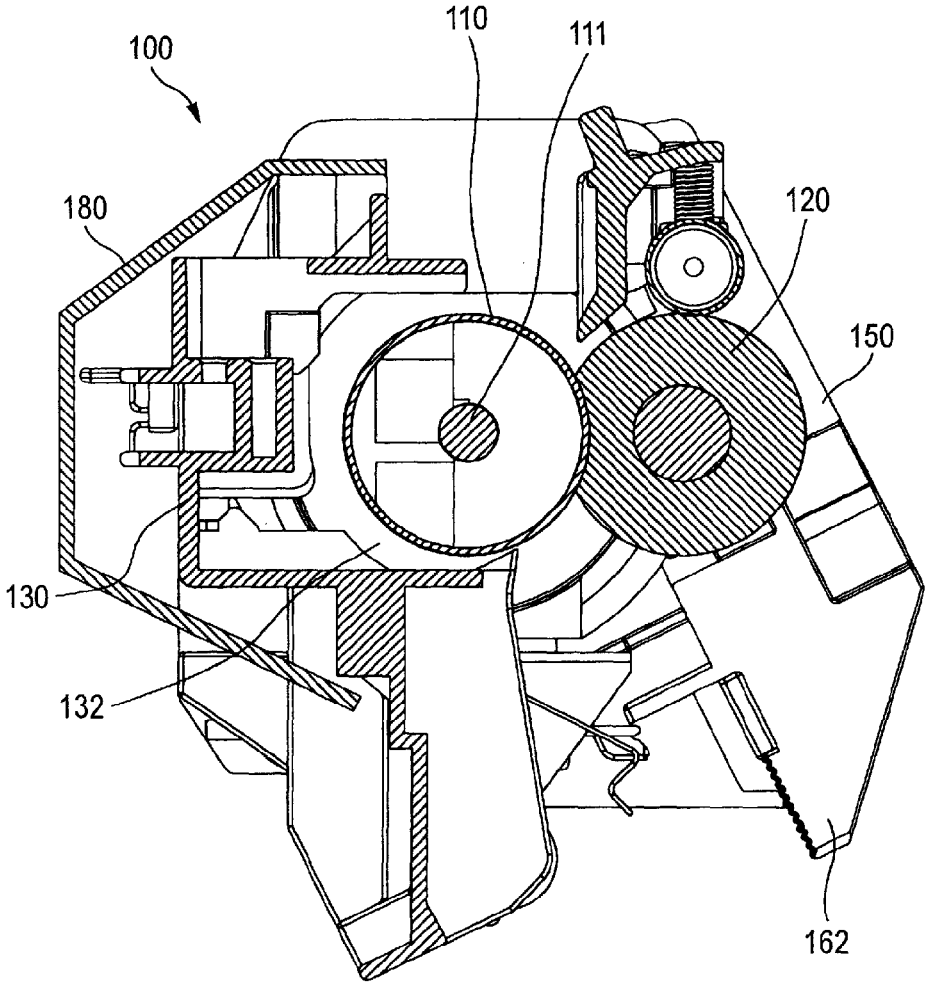
FIG. 9 is an enlarged sectional view of FIG. 8 corresponding to FIG. 6.

Moreover, it is possible to cover the unit case 130 of the fixing unit 100 with a heat insulating cover 180, as shown in FIG. 8. FIG. 8 is a perspective view showing the fixing unit 100 in a state detached from the laser printer 1. FIG. 9 is a sectional view of FIG. 8 corresponding to FIG. 6. The heat insulating cover 180 covers an outside of the unit case 130, whereby the heat insulation performance will be further enhanced as a double structure. Specifically, an outer side of the containing room 132 is further covered with the heat insulating cover 180 so that the heating roller 110 can be thermally insulated.

(Modifications)

Although various aspects of the invention have been heretofore described, it is apparent that contents of the invention are not limited to the specified examples, which have been described in the above described aspects. For example, the following modifications can be carried out.

(1) In the above-described aspects, the end covers are separately constructed, by providing the first end covers 134, 135 on the unit case 130, and the second end covers 154, 155 on the pressurizing roller supporting bodies 150, 151. However, it is possible to integrally form both the first end covers 134, 135 and the second end covers 154, 155, and to provide them on the unit case 130. Alternatively, it is possible to integrally form both the first end covers 134, 135 and the second end covers 154, 155, and to provide them on the pressurizing roller supporting bodies 150, 151.

(2) In the above-described aspects, the heating roller 110 is arranged above the pressurizing roller 120, and the pressurizing roller 120 is so arranged as to be urged toward the heating roller 110 by the recovering forces of the springs 160, 161. However, the structure of the fixing unit 100 is not limited to such arrangement, but the pressurizing roller 120 may be arranged above the heating roller 110. Moreover, such a structure that the pressurizing roller 120 may be urged toward the heating roller 110 by means of a mechanism provided on the laser printer 1 is also considered.

The invention can be applied to, for example, an image forming apparatus in which a toner image transferred onto a recording medium such as recording paper is fixed in a fixing unit, and also can be applied to the fixing unit or the like which is provided on the image forming apparatus.

As was described, in the fixing unit according to an aspect of the invention, because the end covers are provided on the unit case, it is possible to easily form the end covers integrally with the unit case. In the fixing unit according to another aspect of the invention, because the end covers are provided on the pressurizing roller supporting bodies, it is possible to easily conduct maintenance and inspection of the heating roller, and to exchange the heating roller. In the fixing unit according to another aspect of the invention, because some of the end covers are provided on the unit case, it is possible to easily form the end covers integrally with the unit case, and at the same time, it is possible to easily conduct maintenance and inspection of the heating roller, and to exchange the heating roller, by providing the end covers also on the pressurizing roller supporting bodies.

In the fixing unit according to another aspect of the invention, because the pressurizing roller supporting bodies are formed of metal, rigidity of the pressurizing roller supporting bodies can be secured. At the same time, because the end covers are formed of resin, even the end covers having complicated shapes can be easily formed. In the fixing unit according to another aspect of the invention, because the pressurizing roller supporting bodies and the end covers are integrally formed of resin, even the end covers having complicated shapes can be easily formed, and at the same time, the number of components and assembling steps can be decreased.

In the fixing unit according to another aspect of the invention, the end covers include the first end covers which are formed with the openings at their respective sides opposed to the pressurizing roller, and cover both the ends in the longitudinal direction of the heating roller except the openings, and the second end covers for covering the openings in the first end covers. Therefore, it is possible to easily conduct maintenance and inspection of the heating roller, and to exchange the heating roller through the openings. In the fixing unit according to another aspect of the invention, because the first end covers are provided on the unit case, and the second end covers are provided on the pressurizing roller supporting bodies, it is possible to easily form the end covers integrally with the unit case, and because the second end covers are provided on the pressurizing roller supporting bodies, it is possible to easily conduct maintenance and inspection of the heating roller, and to exchange the heating roller. According to another aspect of the invention, downsizing of the image forming apparatus can be advantageously achieved, because the fixing unit according to the invention is employed.

What is claimed is:

1. A fixing unit comprising:

a heating roller;

a pressurizing roller opposed to the heating roller and urged toward the heating roller;

a unit case that rotatably supports both ends in a longitudinal direction of the heating roller, the unit case being open at one side of the heating roller opposed to the pressurizing roller and covering the other side of the heating roller opposite to the pressurizing roller;

a pair of pressurizing roller supporting bodies that are respectively provided at both ends in a longitudinal direction of the unit case and rotatably support both ends of the pressurizing roller; and a pair of end covers that cover both the ends in the longitudinal direction of the heating roller, wherein the end covers comprise first end covers that are formed with openings, which open to the pressurizing roller, the openings being formed at the respective sides of the first end covers, the first end covers enclosing, in the longitudinal direction, both ends of the heating roller except for the openings formed at the respective sides of the first end covers, and second end covers for covering the openings in the first end covers, wherein the second end covers include a pair of second end covers, each one of the pair second end covers is disposed on each of the pair of pressurizing roller supporting bodies, and the second end covers are separately provided from the first end covers, and wherein the pair of pressurizing roller supporting bodies rotates to move the pressurizing roller into contact with or apart from the heating roller and to move the second end covers with the pair of pressurizing roller supporting bodies to cover or expose openings in the first end covers.

2. The fixing unit according to claim 1, wherein the end covers are provided on the unit case.

3. The fixing unit according to claim 1, wherein the end covers are provided on the pressurizing roller supporting bodies.

4. The fixing unit according to claim 3, wherein the pressurizing roller supporting bodies and the end covers are formed of separate members, the pressurizing roller supporting bodies being formed of metal, and the end covers being formed of resin.

5. The fixing unit according to claim 3, wherein the pressurizing roller supporting bodies and the end covers are integrally formed of resin.

6. The fixing unit according to claim 1, wherein each of the end covers is separately provided on the unit case and on the pressurizing roller supporting bodies.

7. The fixing unit according to claim 6, wherein the pressurizing roller supporting bodies and the end covers are formed of separate members, the pressurizing roller supporting bodies being formed of metal, and the end covers being formed of resin.

8. The fixing unit according to claim 6, wherein the pressurizing roller supporting bodies and the end covers are integrally formed of resin.

9. The fixing unit according to claim 1, wherein the first end covers are provided on the unit case, and the second end covers are provided on the pressurizing roller supporting bodies.

10. An image forming apparatus comprising:

an image forming section that forms a toner image on a recording medium; and a fixing unit that fixes the toner image, wherein the fixing unit comprises:

a heating roller;

a pressurizing roller opposed to the heating roller and urged toward the heating roller;

a unit case that rotatably supports both ends in a longitudinal direction of the heating roller, the unit case being open at one side of the heating roller opposed to the pressurizing roller and covering the other side of the heating roller opposite to the pressurizing roller;

a pair of pressurizing roller supporting bodies that are respectively provided at both ends in a longitudinal direction of the unit case and rotatably support both ends of the pressurizing roller; and a pair of end covers that cover both the ends in the longitudinal direction of the heating roller;

wherein the end covers comprise first end covers that are formed with openings, which open to the pressurizing roller, the openings being formed at the respective sides of the first end covers, the first end covers enclosing, in the longitudinal direction, both ends of the heating roller except for the openings formed at the respective sides of the first end covers, and second end covers for covering the openings in the first end covers, wherein the second end covers include a pair of second end covers, each one of the pair second end covers is disposed on each of the pair of pressurizing roller supporting bodies, and the second end covers are separately provided from the first end covers, and wherein the pair of pressurizing roller supporting bodies rotates to move the pressurizing roller into contact with or apart from the heating roller and to move the second end covers with the pair of pressurizing roller supporting bodies to cover or expose openings in the first end covers.

11. The image forming apparatus according to claim 10, wherein the end covers are provided on the unit case.

12. The image forming apparatus according to claim 10, wherein the end covers are provided on the pressurizing roller supporting bodies.

13. The image forming apparatus according to claim 12, wherein the pressurizing roller supporting bodies and the end covers are formed of separate members, the pressurizing roller supporting bodies being formed of metal, and the end covers being formed of resin.

14. The image forming apparatus according to claim 12, wherein the pressurizing roller supporting bodies and the end covers are integrally formed of resin.

15. The image forming apparatus according to claim 10, wherein each of the end covers is separately provided on the unit case and on the pressurizing roller supporting bodies.

16. The image forming apparatus according to claim 15, wherein the pressurizing roller supporting bodies and the end covers are formed of separate members, the pressurizing roller supporting bodies being formed of metal, and the end covers being formed of resin.

17. The image forming apparatus according to claim 15, wherein the pressurizing roller supporting bodies and the end covers are integrally formed of resin.

18. The image forming apparatus according to claim 10, wherein the first end covers are provided on the unit case, and the second end covers are provided on the pressurizing roller supporting bodies.

* * * * *